US011577949B2

(12) United States Patent
Martin

(10) Patent No.: US 11,577,949 B2
(45) Date of Patent: Feb. 14, 2023

(54) PACKAGE OPENING DEVICE

(71) Applicant: Karen Carter Martin, Fredericksburg, TX (US)

(72) Inventor: Karen Carter Martin, Fredericksburg, TX (US)

( * ) Notice: Subject to any disclaimer, the term of this patent is extended or adjusted under 35 U.S.C. 154(b) by 0 days.

(21) Appl. No.: 17/506,776

(22) Filed: Oct. 21, 2021

(65) Prior Publication Data

US 2022/0041423 A1 Feb. 10, 2022

Related U.S. Application Data

(63) Continuation-in-part of application No. 16/845,232, filed on Apr. 10, 2020.

(51) Int. Cl.

| | |
|---|---|
| ***B67B 7/00*** | (2006.01) |
| ***B67B 7/46*** | (2006.01) |
| ***B65B 69/00*** | (2006.01) |

(52) U.S. Cl.

CPC ..... *B67B 7/30* (2013.01); *B65B 69/0033* (2013.01)

(58) Field of Classification Search

CPC . B26B 27/005; B65B 69/003; B65B 69/0041; B67B 7/30

See application file for complete search history.

(56) References Cited

U.S. PATENT DOCUMENTS

| | | | | |
|---|---|---|---|---|
| 4,053,979 A * | 10/1977 | Tuthill | ..... | A61B 17/3201 606/174 |
| 6,598,303 B2 * | 7/2003 | Bosy | ..... | B26B 21/52 30/526 |
| 9,114,543 B2 * | 8/2015 | Votolato | ..... | B26B 27/005 |

* cited by examiner

*Primary Examiner* — Omar Flores Sanchez

(74) *Attorney, Agent, or Firm* — Brian K. Yost; Decker Jones, PC

(57) ABSTRACT

The package opening device generally comprises a body portion, neck portion, and cutting member. In a preferred embodiment, the body portion comprises an elongated ovular configuration. The body portion comprises an upper surface and a lower surface. The neck portion is narrower than the body portion and extends from the proximal end of the body portion. The cutting member is fixed to the body portion and comprises an elongated configuration and is aligned along a central longitudinal axis of the body portion. The cutting member extends downward from the neck portion and body portion and comprises a cutting edge adapted to penetrate a portion of a package.

8 Claims, 3 Drawing Sheets

PACKAGE OPENING DEVICE

This application is a Continuation-in-Part of U.S. patent application Ser. No. 16/845,232, the contents of which are incorporated by reference.

BACKGROUND OF THE INVENTION

1. Field of the Invention

The present invention relates generally to hand tools and specifically to a package opening device adapted for use in opening packages such as blister packs and other sealed containers.

2. Description of the Prior Art

Blister packs are commonly used to package food items, pharmaceuticals, toys, and a variety of other consumer goods. A conventional blister pack comprises an outer shell with a backing of paper or aluminum. Between the outer shell and backing is a cavity within which a product may be inserted. The outer shell of many conventional blister packs is from polyvinylchloride (PVC). Such outer shells are often transparent. A transparent outer shell permits the user to see the contents positioned within the cavity.

The outer shell may be formed in a variety of different manners. Generally, outer shells are formed through thermoforming, cold forming, or a combination of the two. With the thermoforming process, a plastic film is heated and formed into a desired shape, under pressure. With conventional cold forming an aluminum-based film is pressed over a mold into the desired shape or configuration. After the plastic shell is formed, the product is inserted within the cavity. The backing is then affixed to the shell portion, thus, sealing the product within the cavity.

Other containers such as pain reliever bottles and peanut butter jars, and the like have an upper opening which is factory sealed with a protective film barrier. In such configurations, the product is largely protected from moisture, contamination, and tampering.

Unfortunately, the same properties that protect the product often also make blister packs and other sealed containers difficult to open. Users often attempt to tear open the package or use sharp and dangerous instruments unsuited for the task. For example, consumers often attempt to open sealed containers using knives, forks, scissors, or other sharp objects. Thousands of people each year are injured while attempting to open packaging. This problem is compounded when a person is required to open numerous sealed containers each day. For example, nurses and other health care providers are often called upon to open blister packs containing pharmaceuticals. Because there are numerous pharmaceuticals that are packaged in blister packs or sealed containers and a healthcare provider may have numerous patients requiring such medicine, the provider may be called on to open dozens of blister packs and sealed containers every day. Without a safe and effective tool to do this, the safety of healthcare providers and other consumers is at great risk.

What is needed is a package opening device that permits a user to easily and safely open blister pack and other sealed containers and packaging.

SUMMARY OF THE INVENTION

The package opening device generally comprises a body portion, neck portion, and cutting member. In a preferred embodiment, the body portion comprises an elongated ovular configuration. The body portion comprises an upper surface and a lower surface. Adjacent to a distal end of the body portion is a through opening penetrating the upper and lower surfaces. Adjacent to a proximal end of the body portion, the upper surface comprises a recessed area. The neck portion extends from the proximal end of the body portion. Extending downward from a neck portion proximal end is the cutting member. The cutting member comprises a tapered tip.

In one embodiment, the neck portion extends outward on a generally parallel path from the body portion. In this embodiment, the cutting member extends downward from the neck portion at a right angle.

In another embodiment of the package opening device the neck portion extends at an upward angle from the body portion. In this embodiment, the upward angle is preferably 45 degrees from the planar portion of the upper surface, in this embodiment, the cutting member extends downward at a right angle in relation to the neck portion.

The neck portion may comprise other relative angles in relation to the planar portion of the upper surface. The angle can be greater than 45 degrees. The angle can be downward such that the neck extends at a downward angle of between zero and over 90 degrees in relation to the planar portion of the upper surface.

The cutting member is adapted to penetrate conventional packaging while being short enough so as not to present an unreasonable danger to the user. The recessed portion comprises a circular outside configuration which tapers downward. The recessed portion is structured and arranged to receive the user's thumb.

The package opening device of preferred embodiments is formed from polycarbonate material sufficiently strong as to permit a user to open many packages. The package opening device may be formed from any suitable material known in the art. The body portion may be formed from a polycarbonate material and the cutting member may be formed from metal. The package opening device may be formed from a unitary piece of material or may be formed from a combination of parts. For example, the cutting member may be removeably coupled to the neck portion, such as, for instance through cooperative coupling mechanisms well known in the art, including, but not limited to threaded or frictional attachments.

DESCRIPTION OF THE PREFERRED EMBODIMENT

Referring to FIGS. 1-17, there is shown the package opening device 12 in accordance with preferred embodiments. As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment of the present disclosure. Thus, the appearances of such phrases in various places throughout this specification are not necessarily all referring to the same embodiment. Furthermore, the particular features, structures, or characteristics may be combined in any suitable manner on one or more embodiments without limitation.

Figure 1:
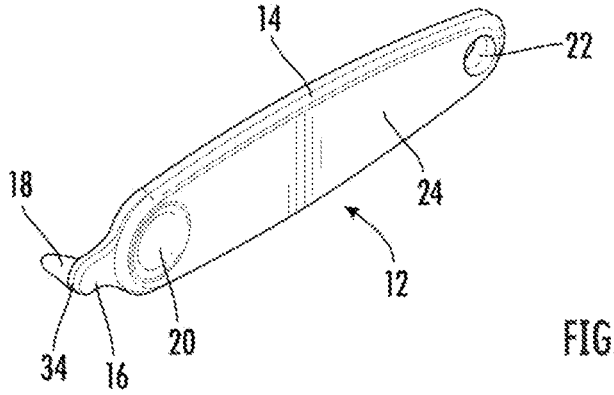
FIG. 1 is an isometric proximal end and top side view of the package opening device in accordance with a preferred embodiment.
Figure 2:
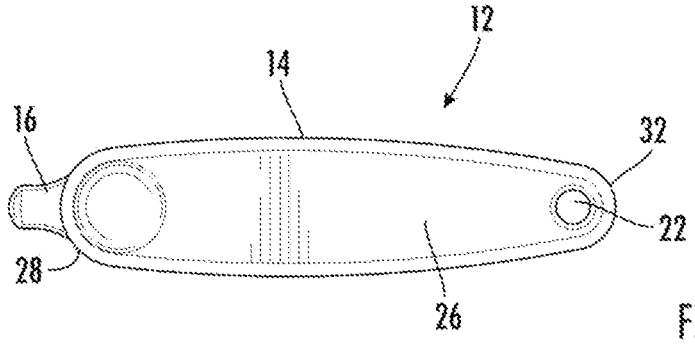
FIG. 2 is a bottom side plan view of the package opening device of FIG. 1.
Figure 3:
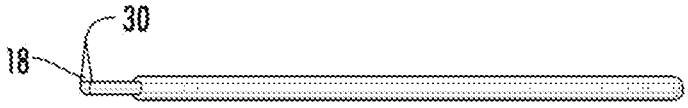
FIG. 3 is a side elevation view of the package opening device of FIG. 1.
Figure 4:
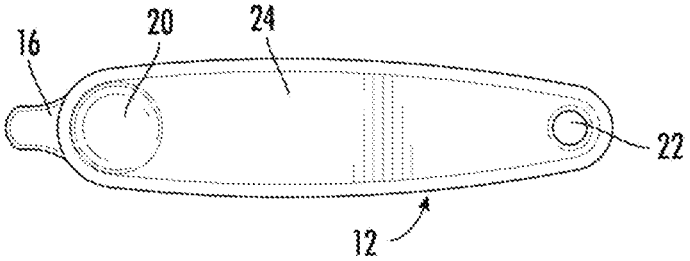
FIG. 4 is a top side elevation view of the package opening device of FIG. 1.
Figure 5:
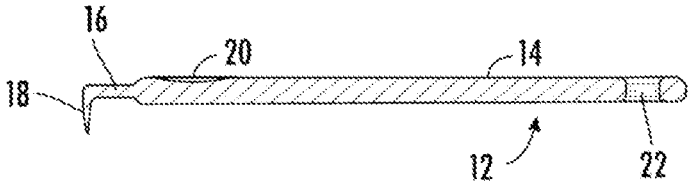
FIG. 5 is sectional view along Section A-A of FIG. 4.
Figure 6:
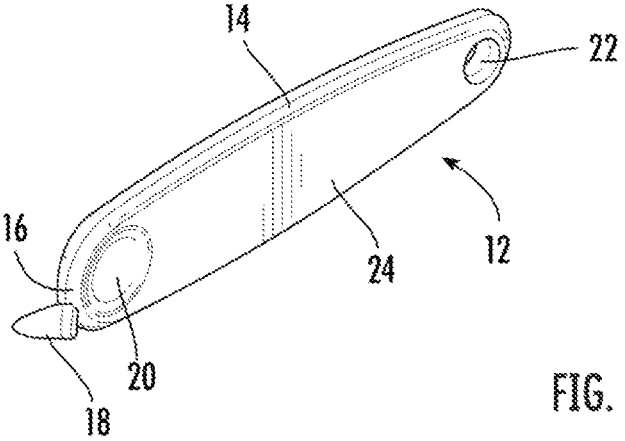
FIG. 6 is an isometric proximal end and top side view of the package opening device in accordance with another preferred embodiment.

Referring to FIGS. 1-5, the package opening device 12 of a first preferred embodiment generally comprises a body portion 14, neck portion 16, and cutting member 18. The neck portion 16 of the preferred embodiment is narrower than the body portion 14. In this preferred embodiment, the body portion 14 comprises an elongated ovular configuration when viewed from above in plan view as shown in FIG. 4. The body portion 14 comprises an upper surface 24 and a lower surface 26 and proximal and distal ends 28, 32. In the preferred embodiment, the proximal end 28 is wider than the distal end 32. The distal end 32 of the body portion 14 comprises a through opening 22 penetrating the upper and lower surfaces 24, 26. The proximal end 28 of the body portion 14 on the upper surface 24, comprises a recessed area 20. The neck portion 16 extends from the proximal end 28 of the body portion 14. Extending downward from a neck portion proximal end 34 is the cutting member 18. The cutting member comprises a tapered tip 30.

In the embodiment depicted in FIGS. 1-5, the neck portion 16 extends outward on a generally parallel path from the body portion 14. In this embodiment, the cutting member 18 extends downward from the neck portion 16 at a right angle.

Figure 7:
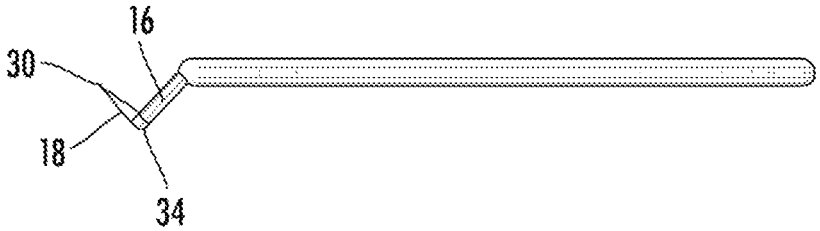
FIG. 7 is a side elevation view of the package opening device of FIG. 6.
Figure 8:
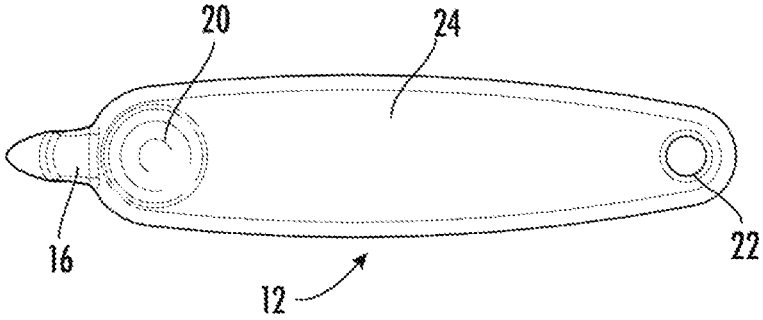
FIG. 8 is a is a top side elevation view of the package opening device of FIG. 6.
Figure 9:
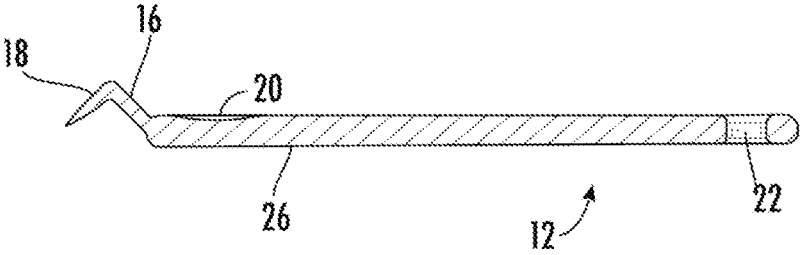
FIG. 9 is a is sectional view along Section A-A of FIG. 8.

Referring to FIGS. 6-9, a second embodiment of the package opening device 12 is shown. The package opening device 12 of the second preferred embodiment generally comprises a body portion 14, neck portion 16, and cutting member 18. In this preferred embodiment, the body portion 14 also comprises an elongated ovular configuration when viewed from above in plan view as shown in FIG. 8. The body portion 14 comprises the upper surface 24 and lower surface 26, through opening 22 and recessed area 20. The neck portion 16 of this embodiment extends at an upward angle from the body portion 14 as best shown in FIGS. 7 and 9. In this preferred embodiment, the upward angle is preferably 45 degrees from the planar portion of the upper surface 24 (the portion not comprising the recessed area 20). In this embodiment, the cutting member 18 extends downward at a right angle in relation to the neck portion 16.

Although the angle of the neck portion 16 in relation to the planar portion of the upper surface 24 is zero degrees in the embodiment in FIGS. 1-5 and 45 degrees in the embodiment in FIGS. 6-9, the neck portion 16 may comprise other relative angles in relation to the planar portion of the upper surface 24. For example, the angle can be greater than 45 degrees. By way of further example, the angle can also be downward such that the neck portion 16 extends at a downward angle of between zero and over 90 degrees in relation to the planar portion of the upper surface 24.

Figure 10:
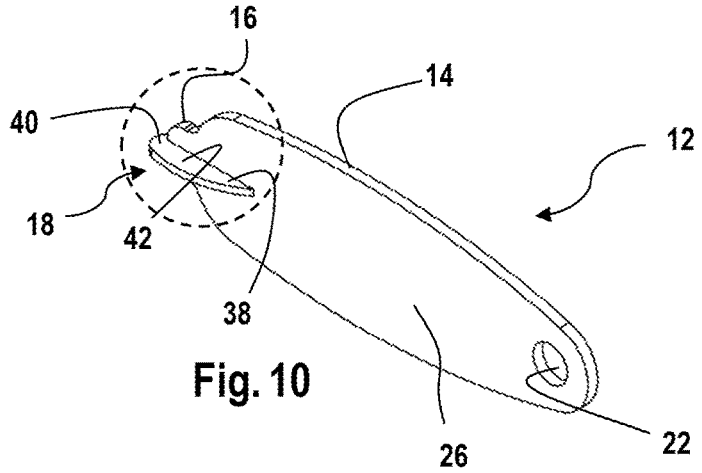
FIG. 10 is an isometric distal end and bottom side view of the package opening device in accordance with another embodiment.
Figure 11:
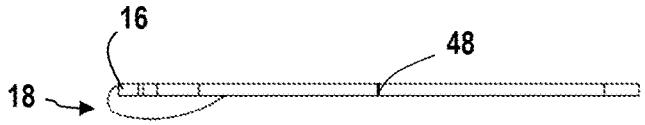
FIG. 11 is a right-side elevation view of the package opening device of FIG. 10.
Figure 12:
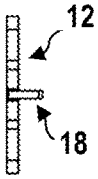
FIG. 12 is a proximal end elevation view of the package opening device of FIG. 10.
Figure 14:
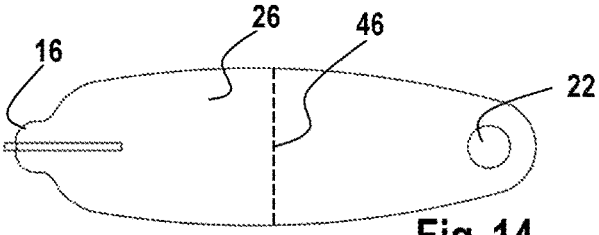
FIG. 14 is a bottom side plan view of the package opening device of FIG. 10.
Figure 13:
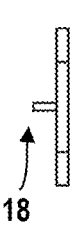
FIG. 13 is a distal end elevation view of the package opening device of FIG. 10.
Figure 15:
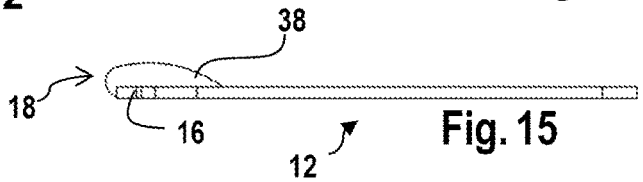
FIG. 15 is a left-side elevation view of the package opening device of FIG. 10.
Figure 16:
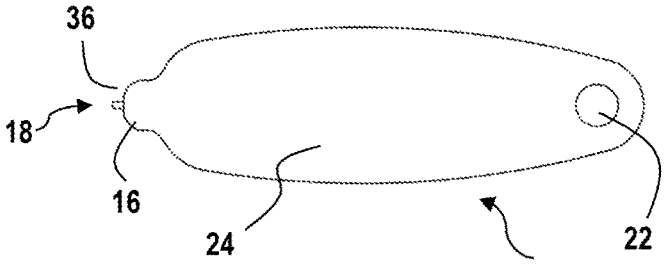
FIG. 16 is a top side plan view of the package opening device of FIG. 10.
Figure 17:
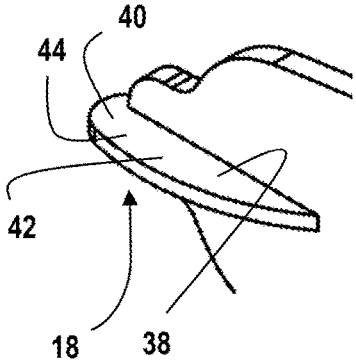
FIG. 17 is an enlarged view of the circled portion of FIG. 10.

Referring to FIGS. 10-17, a third embodiment of the package opening device 12 is shown. The package opening device 12 of the third preferred embodiment generally comprises a body portion 14, neck portion 16, and cutting member 18. In this preferred embodiment, the body portion 14 comprises an elongated generally ovular configuration when viewed from above in plan view as shown in FIGS. 14 and 16. The body portion 14 comprises the upper surface 24 (FIG. 16) and lower surface 26 (FIGS. 10 & 14), and through opening 22. The neck portion 16 of this embodiment extends coplanarly from the body portion 14 as best shown in FIGS. 11 and 15.

As best shown in FIG. 10, in this embodiment, the cutting member 18 comprises an elongated, narrow configuration and comprises a leading portion 40, a central portion 42, and a tail portion 38. Side surfaces define a body portion height 48 (FIG. 11). The upper and lower surfaces 24, 26 each have a central diameter 46 positioned between proximal and distal ends of the body portion. The respective central diameter 46 is greater than the body portion height 48.

The cutting member 18 of this embodiment comprises a longitudinal axis that is coplanar with a longitudinal axis of the main body 14. The cutting member 18 extends downward from the lower surface 26 of the neck portion 16 and body portion 14 and forward from an end portion of the neck 36. Thus, the cutting member 14 is arranged perpendicularly to the body portion 14 forming a keel-like structure. As shown in the side elevation view of the embodiment depicted in FIG. 11, the cutting member 18 comprises an arcuate and tapering configuration such that the cutting member 18 central portion 42 extends further downward than the leading and tail portions 40, 38. The tail portion 38 tapers longitudinally downward to the main body 14. A cutting edge 44 (FIG. 17) of the cutting member 18 of this embodiment is arranged orthogonal to sides of the cutting member 18. Thus, the cutting member 18 of this embodiment is sufficient to penetrate certain packaging, but generally not so sharp as to cause potential injury to the user. In other embodiments, the cutting member 18 may have a tapered cutting edge 18 with respect to the sides such that the cutting member 18 is relatively sharp.

Although the angle of the neck portion 16 in relation to the planar portion of the upper surface 24 is zero degrees in the third embodiment in FIGS. 10-17, the neck portion 16 may comprise other relative angles in relation to the planar portion of the upper surface 24. For example, the angle can be more than zero degrees. By way of further example, the angle can also be downward such that the neck portion 16 extends at a downward angle of between zero and over 90 degrees in relation to the planar portion of the upper surface 24. In other aspects of the third embodiment, the third embodiment comprises the recessed portion 22 described in this disclosure.

In the first two preferred embodiments described herein, the body portion 14 comprises a length of approximately 3¼ inches, a 0.80-inch width, and a 0.15-inch depth. In the first two embodiments, the cutting member 18 comprises a length of approximately 0.05 inches and is, thus, adapted to penetrate conventional packaging while being short enough so as not to present an unreasonable danger to the user. The recessed portion 20 comprises a circular outside configuration which tapers downward. The recessed portion 20 is structured and arranged to receive the user's thumb.

In the third embodiment described herein, the body portion 14 comprises a length of approximately 3⅓ inches, a 0.990-inch width, and a total depth of approximately 0.228-inch depth. In the third embodiment, the cutting member 18 comprises a length of approximately 0.680 inches and a width of approximately 0.048 inch and is, thus, adapted to penetrate conventional packaging while being short enough so as not to present an unreasonable danger to the user.

Although the preferred embodiments comprise the dimensions described herein, the package opening device 12 need not comprise such dimensions. Rather, the package opening device 12 may have dimensions greater or lesser than those described in this disclosure.

The package opening device 12 of the preferred embodiments is formed from polycarbonate material or steel that is sufficiently strong as to permit a user to open many packages. Although the package opening device 12 of the preferred embodiments is formed from polycarbonate or steel material, the package opening device 12 may be formed from any suitable material known in the art. For example, the package opening device 12 may be formed from other metals, composite materials, other plastics or a combination of materials. By way of further example, the body portion 14 may be formed from a polycarbonate material and the cutting member 18 may be formed from metal. The package opening device 12 may be formed from a unitary piece of material or may be formed from a combination of parts. For example, the cutting member 18 may be removeably coupled to the neck portion 16, such as, for instance through cooperative coupling mechanisms well known in the art, including, but not limited to threaded or frictional attachments.

In the third embodiment shown in FIGS. 10-17, the cutting member 18 is formed from 18-gauge mild steel welded or soldered to the body portion 14 which is formed from 14-gauge mild steel. However, the cutting member need not be welded or soldered to the body portion 14. Rather, the package opening device 12 of the third embodiment may be stamped, cast, forged, or formed in other conventional ways known in the art.

The use of the package opening device 12 will now be described. In use, the user preferably grasps the device 12 with a single hand, and in embodiments comprising a recessed portion 22, with the user's thumb positioned within the recessed portion 22. While grasping the package opening device 12 in one hand, the user positions the tapered tip 30 portion of the cutting member 18 (or in the case of the third embodiment, the cutting member 18 leading, central, or tail portions 40, 42, 38) against a portion of a package the user desires to open. While applying pressure against the package with the cutting member 18, the user moves the cutting member 18 through the packaging. A forward, rearward, circular, or sideward motion may be employed in this process.

With respect to the third embodiment depicted in FIGS. 10-17, the elongated, narrow, arcuate configuration of the cutting member 18 is well adapted, for example, to permit the user to open boxes comprising taped flaps. With such boxes, the user positions the cutting member 18 such that it penetrates the tape between the taped flaps. With the tape so penetrated, the user can tilt the package opening device 12 such that the leading portion 40 and central portion 42 remain between the flaps as the user, while applying pressure, slides the package opening device 12 along a path defined by the junction of the two flaps.

The detailed description provided herein illustrates by way of example, not by way of limitation, the principles of the invention. This description will clearly enable one skilled in the art to make and use the invention, and describes several embodiments, adaptations, variations, alternatives, and uses of the invention, including what is presently believed to be the best mode of carrying out the invention.

I claim:

1. A package opening device comprising:

a body portion, a neck portion, and a cutting member;

the body portion comprising an upper surface, a lower surface, a central width, and a height, the central width being greater than the height;

the neck portion extending from a proximal end of the body portion and being narrower than the body portion, the cutting member extending downward from the neck portion and extending forward from a leading portion of the neck;

the cutting member being fixed to the lower surface and comprising an elongated configuration such that a cutting member length is greater than a cutting member width;

a cutting member central longitudinal axis, the cutting member central longitudinal axis being aligned along a central longitudinal axis of the body portion;

the cutting member extending downward from the body portion;

the cutting member comprising a cutting edge adapted to penetrate a portion of a package.

2. The package opening device of claim 1, wherein the body portion comprises an elongated ovular configuration.

3. The package opening device of claim 1, wherein a distal end of the body portion comprises a through opening penetrating the upper and lower surfaces.

4. The package opening device of claim 1, wherein the cutting member comprises an arcuate configuration such that a cutting member central portion extends further downward than leading and tail portions of the cutting member.

5. The package opening device of claim 4, wherein the tail portion tapers longitudinally upward to the lower surface of the body portion.

6. The package opening device of claim 2, wherein a proximal end of the body portion is wider than a distal end of the body portion.

7. The package opening device of claim 1, the upper surface comprising a recessed area adjacent to a proximal end of the body portion.

8. The package opening device of claim 7, a distal end of the body portion comprising a through opening penetrating the upper and lower surfaces.

* * * * *